US005849111A

United States Patent [19]

Igarashi et al.

[11] Patent Number: 5,849,111

[45] Date of Patent: Dec. 15, 1998

[54] DUPLEX STAINLESS STEEL

[75] Inventors: Masaaki Igarashi; Kunio Kondo; Kazuhiro Ogawa; Masakatsu Ueda, all of Osaka; Tomoki Mori, Wakayama, all of Japan

[73] Assignee: Sumitomo Metal Industries, Ltd., Osaka, Japan

[21] Appl. No.: 718,574

[22] PCT Filed: Apr. 4, 1995

[86] PCT No.: PCT/JP95/00647

§ 371 Date: Nov. 6, 1996

§ 102(e) Date: Nov. 6, 1996

[87] PCT Pub. No.: WO95/27090

PCT Pub. Date: Oct. 12, 1995

[30] Foreign Application Priority Data

Apr. 5, 1994 [JP] Japan ..... 6-067473

[51] Int. Cl.[6] ..... C22C 38/44

[52] U.S. Cl. ..... 148/325; 420/67; 420/68; 420/69

[58] Field of Search ..... 148/325; 420/67, 420/68, 69

[56] References Cited

FOREIGN PATENT DOCUMENTS

| | | |
|---|---|---|
| 0220141 | 4/1987 | European Pat. Off. . |
| 0566814 A1 | 10/1993 | European Pat. Off. . |
| 57-13399 | 3/1982 | Japan . |
| 58-224155 | 12/1983 | Japan . |
| 61-113749 | 5/1986 | Japan . |
| 62-56556 | 3/1987 | Japan . |
| 62-180043 | 8/1987 | Japan . |
| 62-180043 | 1/1988 | Japan . |
| 62-267452 | 5/1988 | Japan . |
| 5-098395 | 4/1993 | Japan . |
| 5-132741 | 5/1993 | Japan . |
| 6-116684 | 4/1994 | Japan . |

OTHER PUBLICATIONS

L. Van Nassau et al, "Welding Duplex and Super–Duplex Stainless Steel" (A Guide for Industry pp. 1–15 & 4pp of figures, 1988.

*Primary Examiner*—Deborah Yee

*Attorney, Agent, or Firm*—Burns, Doane, Swecker & Mathis, LLP

[57] ABSTRACT

A super duplex stainless steel with low susceptibility to weld cracks and high weldability, as well as the resistance to stress corrosion cracking and toughness of the weld zones. The steel is therefore suitable for a wide range of applications including heat exchangers exposed to sea water, brine-resistant equipment and structures, pipings in chemical plants, line pipes, and oil well pipes. The steel includes, in weight %, 2.0% or less Si, 2.0% or less Mn, 22.0–24.0% Cr, 4.5–6.5% Ni, 4.0–4.8% Mo, 0.001–0.15% Al, and 0.25–0.35% N, the remains of Fe and inevitable impurities including 0.03% or less C, 0.05% or less P and 0.005% or less S, and a RVS, the index of susceptibility to cracking on welding, 7 or less, and a PREW, the index of pitting resistance, greater than 40.

16 Claims, 18 Drawing Sheets

Fig. 1

(wt>% Fe: bal.)

| | No. | C | Si | Mn | P | S | Cr | Ni | Mo | Al | N | Others |
|---|---|---|---|---|---|---|---|---|---|---|---|---|
| Inventive Steel | 1 | 0.02 | 0.29 | 0.67 | 0.028 | 0.0014 | 22.8 | 6.04 | 4.50 | 0.021 | 0.34 | W:0.02, Cu:0.8 |
| | 2 | 0.02 | 0.36 | 0.69 | 0.018 | 0.0009 | 23.5 | 5.57 | 4.35 | 0.015 | 0.32 | W:0.30, Cu:0.50,B:0.0029,Ca:0.0018 |
| | 3 | 0.02 | 0.33 | 0.61 | 0.022 | 0.0005 | 23.7 | 6.07 | 4.65 | 0.021 | 0.33 | |
| | 4 | 0.01 | 0.37 | 0.46 | 0.019 | 0.0007 | 22.6 | 5.89 | 4.72 | 0.015 | 0.35 | |
| | 5 | 0.02 | 0.25 | 0.44 | 0.022 | 0.0003 | 22.7 | 5.13 | 4.70 | 0.019 | 0.35 | Cu:0.8, V:0.25 |
| | 6 | 0.01 | 0.24 | 0.51 | 0.018 | 0.0008 | 23.2 | 5.08 | 4.77 | 0.032 | 0.35 | Ti:0.13, Y:0.015, Zr:0.25 |
| | 7 | 0.01 | 0.31 | 1.11 | 0.021 | 0.0003 | 23.8 | 6.03 | 4.75 | 0.011 | 0.35 | W:0.03, Cu:0.8, Mg:0.0052, B:0.0031 |
| | 8 | 0.02 | 0.26 | 0.98 | 0.022 | 0.0004 | 23.8 | 4.66 | 4.01 | 0.025 | 0.35 | Nb:0.21 |
| | 9 | 0.01 | 0.42 | 0.53 | 0.003 | 0.0006 | 23.8 | 5.80 | 4.06 | 0.021 | 0.26 | Mg:0.0032 |
| | 10 | 0.02 | 0.19 | 0.49 | 0.031 | 0.0011 | 22.2 | 6.43 | 4.74 | 0.021 | 0.34 | |
| | 11 | 0.01 | 0.13 | 0.54 | 0.026 | 0.0006 | 22.3 | 6.33 | 4.12 | 0.028 | 0.27 | Ti:0.32 |
| | 12 | 0.01 | 0.34 | 0.66 | 0.018 | 0.0004 | 23.7 | 6.48 | 4.52 | 0.028 | 0.28 | V:0.15, Cu:0.5, Zr:0.22 |

Fig. 2

(wt > % Fe: bal.)

| | No. | C | Si | Mn | P | S | Cr | Ni | Mo | Al | N | Others |
|---|---|---|---|---|---|---|---|---|---|---|---|---|
| Comparative Steel | 13 | 0.01 | 0.35 | 1.03 | 0.001 | 0.0005 | 22.6 | 4.51 | 4.72 | 0.027 | 0.274 | REM:0.0025 |
| | 14 | 0.01 | 0.32 | 0.56 | 0.025 | 0.0006 | 22.2 | 3.91* | 4.76 | 0.018 | 0.31 | |
| | 15 | 0.01 | 0.35 | 0.52 | 0.021 | 0.0008 | 20.1* | 4.13* | 5.89* | 0.024 | 0.35 | |
| | 16 | 0.01 | 0.31 | 0.55 | 0.022 | 0.0013 | 21.3* | 4.04 | 6.22* | 0.014 | 0.32 | |
| | 17 | 0.02 | 0.45 | 0.51 | 0.023 | 0.0011 | 23.9 | 4.66 | 5.89* | 0.031 | 0.35 | |
| | 18 | 0.02 | 0.32 | 0.48 | 0.019 | 0.0005 | 23.8 | 4.57 | 4.68 | 0.024 | 0.290 | W:0.02, Cu:0.60, V:0.11 |
| | 19 | 0.03 | 0.41 | 0.54 | 0.025 | 0.0007 | 23.7 | 4.69 | 4.72 | 0.024 | 0.23* | B:0.0029 |

Note: *indicates values out of the ranges specified in the invention.

Fig. 4

| | No. | PREW | RSCC | RVS | Crack length mm |
|---|---|---|---|---|---|
| Inventive Steel | 1 | 43.1 | 13.2 | 5.29 | 0.3 |
| | 2 | 43.0 | 14.7 | 5.74 | 0.5 |
| | 3 | 44.3 | 13.6 | 5.46 | 0.4 |
| | 4 | 43.9 | 13.4 | 5.54 | 0.6 |
| | 5 | 43.8 | 15.5 | 6.35 | 0.6 |
| | 6 | 44.5 | 16.0 | 6.53 | 0.7 |
| | 7 | 45.6 | 13.8 | 5.58 | 0.3 |
| | 8 | 42.6 | 17.8 | 6.65 | 0.8 |
| | 9 | 41.4 | 14.3 | 6.68 | 0.4 |
| | 10 | 43.3 | 12.1 | 5.03 | 0.5 |
| | 11 | 40.2 | 12.3 | 4.48 | 0.7 |
| | 12 | 43.1 | 12.8 | 5.04 | 0.2 |

Fig. 5

| | No. | PREW | RSCC | RVS | Crack length mm |
|---|---|---|---|---|---|
| Comparative Steel | 13 | 42.6 | 17.6 | 7.22** | 1.2 |
| | 14 | 42.9 | 19.9** | 30* | 3.1 |
| | 15 | 45.1 | 17.3 | 8.44** | 2.3 |
| | 16 | 46.9 | 18.7** | 9.13* | 2.5 |
| | 17 | 49.4 | 18.1** | 8.09* | 1.8 |
| | 18 | 43.9 | 18.2** | 7.29* | 1.2 |
| | 19 | 43.0 | 17.7 | 7.11* | 1.5 |

Note: *indicates values out of the ranges specified in the invention
**indicated values out of preferred ranges

Fig. 7

(wt > % Fe: bal.)

| | No. | C | Si | Mn | P | S | Cr | Ni | Mo | Al | N | Others |
|---|---|---|---|---|---|---|---|---|---|---|---|---|
| Inventive Steel | 1 | 0.01 | 0.32 | 0.56 | 0.025 | 0.0006 | 22.7 | 5.03 | 4.12 | 0.012 | 0.32 | |
| | 2 | 0.01 | 0.35 | 0.52 | 0.021 | 0.0008 | 22.9 | 5.10 | 4.33 | 0.015 | 0.29 | |
| | 3 | 0.01 | 0.31 | 0.55 | 0.022 | 0.0013 | 23.1 | 4.97 | 4.15 | 0.022 | 0.29 | |
| | 4 | 0.01 | 0.42 | 0.53 | 0.003 | 0.0006 | 23.3 | 6.11 | 4.18 | 0.023 | 0.31 | |
| | 5 | 0.01 | 0.37 | 0.72 | 0.020 | 0.0014 | 22.8 | 5.15 | 4.30 | 0.013 | 0.33 | |
| | 6 | 0.02 | 0.33 | 0.59 | 0.019 | 0.0008 | 22.5 | 5.97 | 4.28 | 0.031 | 0.29 | |
| | 7 | 0.01 | 0.31 | 0.55 | 0.024 | 0.0013 | 22.7 | 6.01 | 4.77 | 0.041 | 0.28 | |
| | 8 | 0.02 | 0.41 | 0.34 | 0.028 | 0.0007 | 23.1 | 5.41 | 4.06 | 0.023 | 0.25 | |
| | 9 | 0.01 | 0.39 | 0.27 | 0.023 | 0.0012 | 22.9 | 5.08 | 4.25 | 0.011 | 0.27 | |
| | 10 | 0.02 | 0.31 | 0.41 | 0.031 | 0.0011 | 22.8 | 4.99 | 4.13 | 0.024 | 0.28 | |
| | 11 | 0.02 | 0.45 | 0.51 | 0.023 | 0.0011 | 22.9 | 4.88 | 4.08 | 0.038 | 0.28 | W:0.27, Cu:0.51 |
| | 12 | 0.01 | 0.37 | 0.46 | 0.019 | 0.0007 | 23.5 | 5.08 | 4.69 | 0.044 | 0.26 | W:0.05 |
| | 13 | 0.02 | 0.25 | 0.44 | 0.022 | 0.0003 | 23.2 | 5.24 | 4.36 | 0.051 | 0.28 | Cu:0.83 |
| | 14 | 0.02 | 0.19 | 0.49 | 0.031 | 0.0011 | 22.8 | 5.34 | 4.40 | 0.043 | 0.27 | Ti:0.25 |
| | 15 | 0.01 | 0.24 | 0.51 | 0.018 | 0.0008 | 23.9 | 4.70 | 4.18 | 0.027 | 0.33 | Nb:0.36 |
| | 16 | 0.01 | 0.13 | 0.54 | 0.026 | 0.0006 | 22.6 | 4.76 | 4.73 | 0.011 | 0.27 | V:0.18 |
| | 17 | 0.02 | 0.32 | 0.48 | 0.019 | 0.0005 | 23.2 | 5.02 | 4.22 | 0.026 | 0.28 | Ca:0.0034 |

Fig. 8

(wt>% Fe: bal.)

| | No. | C | Si | Mn | P | S | Cr | Ni | Mo | Al | N | Others |
|---|---|---|---|---|---|---|---|---|---|---|---|---|
| Inventive Steel | 18 | 0.02 | 0.36 | 0.69 | 0.018 | 0.0009 | 23.3 | 5.29 | 4.53 | 0.02 | 0.29 | Zr:0.26 |
| | 19 | 0.02 | 0.33 | 0.61 | 0.022 | 0.0005 | 23.3 | 5.36 | 4.21 | 0.031 | 0.27 | La:0.0038 |
| | 20 | 0.01 | 0.34 | 0.66 | 0.018 | 0.0004 | 23.2 | 6.07 | 4.65 | 0.033 | 0.28 | Y:0.0075 |
| | 21 | 0.02 | 0.26 | 0.98 | 0.022 | 0.0004 | 22.8 | 5.54 | 4.31 | 0.019 | 0.3 | Zr:0.12, Y:0.0030 |
| | 22 | 0.02 | 0.32 | 0.58 | 0.000 | 0.0005 | 23.8 | 5.84 | 4.31 | 0.064 | 0.29 | Ca:0.0026, Y:0.011 |
| | 23 | 0.01 | 0.32 | 0.53 | 0.033 | 0.0005 | 23.0 | 5.22 | 4.13 | 0.043 | 0.25 | Zr:0.014, Y:0.0025 |
| | 24 | 0.02 | 0.29 | 0.67 | 0.028 | 0.0014 | 23.1 | 4.81 | 4.06 | 0.023 | 0.27 | Mg:0.0022, W:1.22 |
| | 25 | 0.01 | 0.35 | 1.03 | 0.001 | 0.0005 | 22.8 | 6.04 | 4.50 | 0.024 | 0.33 | Cu:0.47, B:0.0031, Ca:0.0036 |
| | 26 | 0.03 | 0.41 | 0.54 | 0.025 | 0.0007 | 23.8 | 4.80 | 4.71 | 0.031 | 0.31 | W:0.33, Mg:0.0028, B:0.0024 |
| | 27 | 0.02 | 0.25 | 0.44 | 0.022 | 0.0003 | 22.5 | 4.95 | 4.55 | 0.015 | 0.31 | Cu:0.65, Nb:0.27 |
| | 28 | 0.02 | 0.24 | 0.51 | 0.015 | 0.0003 | 23.1 | 5.01 | 4.63 | 0.018 | 0.29 | W:0.31, V:0.19 |
| | 29 | 0.02 | 0.30 | 0.53 | 0.027 | 0.0017 | 22.7 | 4.96 | 4.57 | 0.015 | 0.28 | B:0.0031, Y:0.0027, W:0.32 |
| | 30 | 0.01 | 0.38 | 0.14 | 0.015 | 0.0005 | 23.2 | 5.14 | 4.02 | 0.014 | 0.29 | Cu:0.55, Y:0.0084 |
| | 31 | 0.01 | 0.31 | 1.11 | 0.021 | 0.0003 | 22.9 | 5.57 | 4.35 | 0.026 | 0.31 | Ti:0.25, Ca:0.0028, W:0.04 |
| | 32 | 0.02 | 0.22 | 0.30 | 0.022 | 0.0009 | 23.1 | 5.84 | 4.12 | 0.031 | 0.29 | V:0.013, Ca:0.0025 |
| | 33 | 0.02 | 1.10 | 0.54 | 0.002 | 0.0007 | 23.8 | 5.49 | 4.06 | 0.022 | 0.29 | W:0.14, V:0.13, B:0.0026 |

Fig. 9

(wt > % Fe: bal.)

| | No. | C | Si | Mn | P | S | Cr | Ni | Mo | Al | N | Others |
|---|---|---|---|---|---|---|---|---|---|---|---|---|
| Conventional Steel | 34 | 0.01 | 0.32 | 0.49 | 0.023 | 0.0021 | 24.8* | 8.20* | 3.96* | 0.02 | 0.28 | |
| | 35 | 0.02 | 0.57 | 0.55 | 0.021 | 0.0024 | 25.3* | 7.50* | 4.12 | 0.024 | 0.31 | |
| | 36 | 0.01 | 0.84 | 0.56 | 0.015 | 0.0015 | 25.1* | 7.02* | 3.90* | 0.034 | 0.30 | |
| | 37 | 0.02 | 0.46 | 0.78 | 0.016 | 0.0019 | 25.3* | 8.50* | 3.41* | 0.021 | 0.25 | |
| | 38 | 0.02 | 0.38 | 0.67 | 0.034 | 0.0031 | 25.3* | 7.30* | 4.13 | 0.015 | 0.28 | |
| | 39 | 0.02 | 0.45 | 0.39 | 0.022 | 0.0015 | 24.9* | 6.65* | 3.75* | 0.023 | 0.27 | W:0.7 |
| | 40 | 0.01 | 0.39 | 0.44 | 0.018 | 0.0021 | 25.3* | 6.70* | 4.11 | 0.031 | 0.31 | |
| | 41 | 0.01 | 0.64 | 0.85 | 0.019 | 0.0024 | 23.5 | 6.92* | 4.11 | 0.032 | 0.18* | |
| | 42 | 0.03 | 0.71 | 0.34 | 0.015 | 0.0025 | 25.5* | 6.60* | 4.15 | 0.017 | 0.33* | |
| Comparative Steel | 43 | 0.02 | 0.47 | 0.77 | 0.019 | 0.0021 | 23.7 | 4.53 | 4.12 | 0.016 | 0.26 | |
| | 44 | 0.02 | 0.28 | 0.83 | 0.024 | 0.0020 | 22.1 | 6.44 | 4.26 | 0.031 | 0.33 | |
| | 45 | 0.01 | 0.54 | 0.51 | 0.028 | 0.0018 | 22.5 | 6.22 | 4.28 | 0.033 | 0.31 | |
| | 46 | 0.02 | 0.36 | 0.80 | 0.024 | 0.0024 | 24.0 | 4.55 | 4.50 | 0.021 | 0.32 | W:0.3 |
| | 47 | 0.02 | 0.65 | 0.85 | 0.023 | 0.0023 | 22.9 | 6.31 | 4.55 | 0.035 | 0.28 | |
| | 48 | 0.01 | 0.44 | 0.79 | 0.022 | 0.0016 | 23.6 | 4.53 | 4.61 | 0.023 | 0.27 | |
| | 49 | 0.01 | 0.51 | 0.75 | 0.020 | 0.0021 | 23.9 | 4.51 | 4.70 | 0.015 | 0.26 | |
| | 50 | 0.02 | 0.32 | 0.82 | 0.025 | 0.0011 | 23.9 | 4.61 | 4.75 | 0.011 | 0.26 | |
| | 51 | 0.01 | 0.45 | 1.21 | 0.026 | 0.0022 | 22.1 | 6.40 | 4.77 | 0.032 | 0.33 | |
| | 52 | 0.02 | 0.51 | 1.80 | 0.025 | 0.0021 | 22.6 | 6.28 | 4.44 | 0.028 | 0.31 | |

Note: *indicates values out of the ranges specified in the invention.

Fig. 12(a)
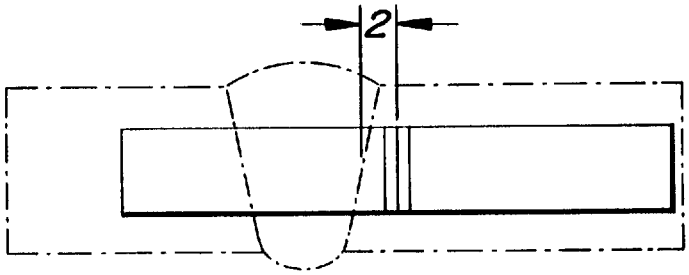
Fig. 12(b)
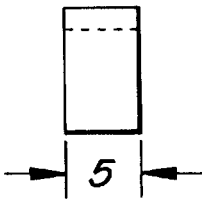
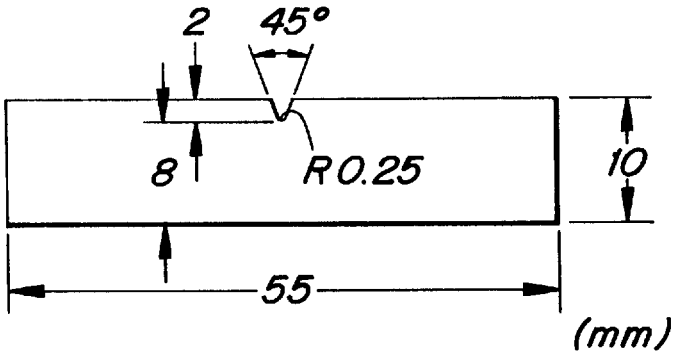
Fig. 12(c)

Fig. 13.

| | No. | α % | PREW | RSCC | RVS | Change in α, % |
|---|---|---|---|---|---|---|
| Inventive Steel | 1 | 44.7 | 41.4 | 15.8 | 6.08 | 5.4 |
| | 2 | 48.2 | 41.8 | 15.7 | 6.16 | 5.7 |
| | 3 | 49.3 | 41.4 | 16.3 | 6.23 | 4.0 |
| | 4 | 42.9 | 42.1 | 13.3 | 5.11 | 5.7 |
| | 5 | 44.6 | 42.3 | 15.5 | 6.07 | 5.3 |
| | 6 | 40.7 | 41.3 | 13.2 | 5.19 | 5.2 |
| | 7 | 44.2 | 42.9 | 13.3 | 5.46 | 5.1 |
| | 8 | 49.0 | 40.5 | 14.9 | 5.66 | 5.4 |
| | 9 | 49.2 | 41.2 | 15.8 | 6.13 | 5.6 |
| | 10 | 48.1 | 40.9 | 16.0 | 6.15 | 5.2 |
| | 11 | 49.4 | 41.3 | 16.4 | 6.28 | 5.1 |
| | 12 | 50.3 | 43.2 | 16.2 | 6.52 | 5.3 |
| | 13 | 49.9 | 42.1 | 15.5 | 6.06 | 5.1 |
| | 14 | 47.8 | 41.6 | 15.0 | 5.92 | 5.3 |
| | 15 | 53.1 | 43.0 | 17.8 | 6.73 | 8.3 |
| | 16 | 51.2 | 42.5 | 16.7 | 6.85 | 5.2 |
| | 17 | 50.6 | 41.6 | 16.2 | 6.23 | 5.1 |

Fig. 14.

| | No | α % | PREW | RSCC | RVS | Change in α, % |
|---|---|---|---|---|---|---|
| Inventive Steel | 18 | 50.2 | 42.9 | 15.4 | 6.13 | 5.3 |
| | 19 | 49.8 | 41.5 | 15.2 | 5.84 | 3.4 |
| | 20 | 46.3 | 43.0 | 13.4 | 5.40 | 5.9 |
| | 21 | 44.4 | 41.8 | 14.4 | 5.65 | 5.2 |
| | 22 | 49.1 | 42.7 | 14.3 | 5.48 | 5.8 |
| | 23 | 49.8 | 40.6 | 15.4 | 5.90 | 5.8 |
| | 24 | 52.6 | 42.8 | 16.9 | 6.47 | 5.9 |
| | 25 | 40.4 | 42.9 | 13.2 | 5.29 | 8.4 |
| | 26 | 50.2 | 44.8 | 17.4 | 6.99 | 6.1 |
| | 27 | 48.7 | 42.5 | 16.0 | 6.45 | 5.1 |
| | 28 | 52.3 | 43.5 | 16.2 | 6.54 | 5.5 |
| | 29 | 49.8 | 42.8 | 16.1 | 6.50 | 6.3 |
| | 30 | 48.4 | 41.1 | 15.8 | 5.95 | 6.0 |
| | 31 | 44.3 | 42.3 | 14.4 | 5.66 | 5.3 |
| | 32 | 44.3 | 41.3 | 13.8 | 5.28 | 5.8 |
| | 33 | 50.3 | 42.1 | 15.1 | 5.68 | 5.2 |

Fig. 15.

| | No | α % | PREW | RSCC | RVS | Change in α, % |
|---|---|---|---|---|---|---|
| Conventional Steel | 34 | 40.7 | 42.3 | 10.5** | 3.84 | 20** |
| | 35 | 46.3 | 43.9 | 11.8** | 4.32 | 14** |
| | 36 | 47.6 | 42.8 | 12.5** | 4.49 | 11** |
| | 37 | 41.6 | 40.6 | 10.3** | 3.52 | 18** |
| | 38 | 49.4 | 43.4 | 12.1** | 4.45 | 12** |
| | 39 | 50.7 | 42.8 | 13.1 | 4.68 | 11** |
| | 40 | 50.8 | 43.8 | 13.2 | 4.83 | 11** |
| | 41 | 47.2 | 40.0 | 11.9** | 4.49 | 15** |
| | 42 | 51.4 | 44.3 | 13.5 | 4.95 | 13** |
| Comparative Steel | 43 | 57.1 | 41.5 | 18.3** | 6.90 | 14** |
| | 44 | 33.2 | 41.5 | 12.0** | 4.76 | 11** |
| | 45 | 37.8 | 41.5 | 12.7** | 4.98 | 17** |
| | 46 | 56.8 | 44.5 | 18.5** | 7.24* | 12** |
| | 47 | 42.5 | 42.3 | 12.7** | 5.10 | 10** |
| | 48 | 57.9 | 43.1 | 18.3** | 7.27* | 13** |
| | 49 | 60.7 | 43.6 | 18.6** | 7.42* | 15** |
| | 50 | 60.4 | 43.7 | 18.2** | 7.29* | 16** |
| | 51 | 35.3 | 43.1 | 12.2** | 5.06 | 16** |
| | 52 | 38.9 | 42.2 | 12.6** | 5.03 | 15** |

Note: * indicates values out of the ranges specified in the invention.
**indicates values out of preferred ranges

Fig. 16

| | No. | $\sigma_y$ (Room temperature) ($kgf/mm^2$) | Elongation (%) | Constriction (%) | vE-30 ($J/cm^2$) | Stress applied in stress corrosion test of the weld zone $\sigma/\sigma_y$ | | | | | Critical stress for cracking $\sigma_{th}$ ($kgf/mm^2$) |
|---|---|---|---|---|---|---|---|---|---|---|---|
| | | | | | | 0.80 | 0.85 | 0.90 | 0.95 | 1.0 | |
| Inventive Steel | 1 | 56.1 | 32 | 72 | 254 | ○ | ○ | ○ | ○ | ● | 53.3 |
| | 2 | 55.7 | 33 | 72 | 244 | ○ | ○ | ○ | ○ | ● | 52.9 |
| | 3 | 56.3 | 31 | 74 | 237 | ○ | ○ | ○ | ○ | ● | 53.5 |
| | 4 | 56.6 | 34 | 72 | 291 | ○ | ○ | ○ | ○ | ● | 53.8 |
| | 5 | 57.1 | 33 | 75 | 295 | ○ | ○ | ○ | ○ | ● | 54.2 |
| | 6 | 56.4 | 35 | 74 | 223 | ○ | ○ | ○ | ○ | ○ | 56.4 |
| | 7 | 58.1 | 31 | 72 | 275 | ○ | ○ | ○ | ○ | ● | 55.2 |
| | 8 | 56.9 | 35 | 74 | 279 | ○ | ○ | ○ | ○ | ○ | 56.9 |
| | 9 | 55.8 | 34 | 72 | 235 | ○ | ○ | ○ | ○ | ● | 53.0 |
| | 10 | 56.4 | 33 | 72 | 236 | ○ | ○ | ○ | ○ | ● | 53.6 |
| | 11 | 55.5 | 35 | 72 | 267 | ○ | ○ | ○ | ○ | ● | 52.7 |
| | 12 | 58.2 | 32 | 74 | 310 | ○ | ○ | ○ | ○ | ○ | 58.2 |
| | 13 | 56.4 | 35 | 72 | 254 | ○ | ○ | ○ | ○ | ○ | 56.4 |
| | 14 | 56.8 | 36 | 72 | 241 | ○ | ○ | ○ | ○ | ○ | 56.8 |
| | 15 | 56.1 | 33 | 72 | 308 | ○ | ○ | ○ | ○ | ○ | 56.1 |
| | 16 | 56.3 | 37 | 72 | 222 | ○ | ○ | ○ | ○ | ○ | 56.3 |
| | 17 | 55.9 | 32 | 74 | 265 | ○ | ○ | ○ | ○ | ● | 53.1 |

Note: ○ = No cracking ● = Cracks developed

Fig. 17

| | No. | $\sigma_y$ (Room temperature) (kgf/mm$^2$) | Elongation (%) | Constriction (%) | vE-30 (J/cm$^2$) | Stress applied in stress corrosion test of the weld zone $\sigma/\sigma_y$ | | | | | Critical stress for cracking $\sigma_{th}$ (kgf/mm$^2$) |
|---|---|---|---|---|---|---|---|---|---|---|---|
| | | | | | | 0.80 | 0.85 | 0.90 | 0.95 | 1.0 | |
| Inventive Steel | 18 | 55.8 | 34 | 72 | 243 | ○ | ○ | ○ | ○ | ○ | 55.8 |
| | 19 | 55.4 | 32 | 69 | 266 | ○ | ○ | ○ | ○ | ● | 52.6 |
| | 20 | 57.5 | 33 | 72 | 258 | ○ | ○ | ○ | ○ | ○ | 57.5 |
| | 21 | 56.8 | 30 | 72 | 241 | ○ | ○ | ○ | ○ | ○ | 56.8 |
| | 22 | 55.8 | 33 | 75 | 301 | ○ | ○ | ○ | ○ | ○ | 55.8 |
| | 23 | 57.2 | 38 | 72 | 244 | ○ | ○ | ○ | ○ | ○ | 57.2 |
| | 24 | 54.7 | 35 | 74 | 281 | ○ | ○ | ○ | ○ | ○ | 54.7 |
| | 25 | 56.2 | 35 | 69 | 216 | ○ | ○ | ○ | ○ | ● | 53.4 |
| | 26 | 56.4 | 36 | 72 | 227 | ○ | ○ | ○ | ○ | ○ | 56.4 |
| | 27 | 55.8 | 37 | 71 | 219 | ○ | ○ | ○ | ○ | ○ | 55.8 |
| | 28 | 56.3 | 35 | 69 | 223 | ○ | ○ | ○ | ○ | ○ | 56.3 |
| | 29 | 56.3 | 37 | 77 | 221 | ○ | ○ | ○ | ○ | ○ | 56.3 |
| | 30 | 56.7 | 36 | 77 | 245 | ○ | ○ | ○ | ○ | ○ | 56.7 |
| | 31 | 56.0 | 31 | 72 | 244 | ○ | ○ | ○ | ○ | ● | 53.2 |
| | 32 | 53.2 | 32 | 72 | 252 | ○ | ○ | ○ | ○ | ○ | 53.2 |
| | 33 | 55.8 | 36 | 73 | 212 | ○ | ○ | ○ | ○ | ○ | 55.8 |

Note: ○ = No cracking ● = Cracks developed

Fig. 18

| | No. | $\sigma_y$ (Room temperature) (kgf/mm$^2$) | Elongation (%) | Constriction (%) | vE-30 (J/cm$^2$) | Stress applied in stress corrosion test of the weld zone $\sigma/\sigma_y$ 0.80 | 0.85 | 0.90 | 0.95 | 1.0 | Critical stress for cracking $\sigma_{th}$ (kgf/mm$^2$) |
|---|---|---|---|---|---|---|---|---|---|---|---|
| Inventive Steel | 34 | 52.4 | 29 | 69 | 205 | ● | ● | ● | ● | ● | <41.9 |
| | 35 | 53.1 | 35 | 68 | 212 | ○ | ● | ● | ● | ● | 42.5 |
| | 36 | 48.6 | 36 | 69 | 204 | ● | ● | ● | ● | ● | <38.9 |
| | 37 | 51.1 | 35 | 71 | 211 | ● | ● | ● | ● | ● | <40.9 |
| | 38 | 51.4 | 37 | 72 | 201 | ● | ● | ● | ● | ● | <41.1 |
| | 39 | 53.6 | 38 | 71 | 202 | ● | ● | ● | ● | ● | <42.9 |
| | 40 | 49.3 | 35 | 75 | 188 | ○ | ● | ● | ● | ● | 41.9 |
| | 41 | 52.2 | 36 | 71 | 165 | ○ | ● | ● | ● | ● | 44.4 |
| | 42 | 55.8 | 36 | 72 | 185 | ○ | ● | ● | ● | ● | 44.6 |
| Comparative Steel | 43 | 47.6 | 37 | 75 | 178 | ● | ● | ● | ● | ● | <38.1 |
| | 44 | 46.9 | 38 | 72 | 196 | ● | ● | ● | ● | ● | <37.5 |
| | 45 | 47.7 | 35 | 71 | 205 | ● | ● | ● | ● | ● | <38.2 |
| | 46 | 58.3 | 37 | 72 | 165 | ○ | ● | ● | ● | ● | 46.6 |
| | 47 | 56.5 | 34 | 72 | 164 | ○ | ● | ● | ● | ● | 45.2 |
| | 48 | 55.4 | 35 | 71 | 155 | ○ | ○ | ● | ● | ● | 47.1 |
| | 49 | 54.8 | 37 | 75 | 148 | ● | ● | ● | ● | ● | <43.8 |
| | 50 | 53.8 | 33 | 75 | 143 | ○ | ● | ● | ● | ● | 43.0 |
| | 51 | 54.2 | 32 | 71 | 158 | ● | ● | ● | ● | ● | <43.4 |
| | 52 | 53.3 | 36 | 75 | 139 | ○ | ● | ● | ● | ● | 42.6 |

Note: ○ = No cracking ● = Cracks developed

DUPLEX STAINLESS STEEL

FIELD OF THE INVENTION

The present invention relates to a duplex stainless steel consisting of an austenitic phase and a ferritic phase. More specifically, it relates to a super duplex stainless steel suitable for welding providing high resistance to stress corrosion cracking and high toughness of the weld zones, which can be applied to heat exchangers exposed to sea water, brine-resistant chemical equipment and structures, pipings in chemical plants, line pipes, and oil well pipes.

BACKGROUND

Duplex stainless steel with high corrosion resistance and weldability has recently been in great demand for heat exchangers exposed to sea water, brine-resistant chemical equipment and structures, pipings in chemical plants, line pipes, and oil well pipes. This requirement of corrosion resistance is particularly stringent.

Many types of duplex stainless steel are commercially available. For example, "Weldable duplex stainless steels and super duplex stainless steels" by L. van Nassau, H. Meelker and J. Hilker (Dutch Welding Association, 1991) discloses four alloys listed as (a)–(d) below in the order of increasing corrosion resistance:

(a) 23% Cr-4% Ni-0.1% N . . . duplex stainless steel (PREN<25), (b) 22% Cr-5.5% Ni-3% Mo-0.1% N . . . duplex stainless steel (PREN=30–36), (c) 25% Cr-6% Ni-3% Mo-0.2% N-(0–2.5)%Cu-(Mn, W) . . . duplex stainless steel (PREN=32–40), and (d) 25% Cr-7% Ni-3.5% Mo-0.25% N-0.6% Cu-(0.3–0.7)% W super duplex stainless steel (PREN>40), where PREN is an index for pitting resistance defined as %Cr+3.3×%Mo+16×%N. The greater the PREN is, the higher pitting resistance.

Super duplex stainless steel is designed to have desirable mechanical properties and high corrosion resistance as represented by PREN, defined above, greater than 40, by incorporating a high concentration of N in a 25% Cr steel as a basic component.

JP62-56556 proposes a highly corrosion-resistant super duplex stainless steel with a highly stable microstructure containing a relatively high amount of N, specified in relation to concentrations of other components, and a specified amount of the ferrite phase. This steel has a PREN defined by $$PREN=\%Cr+3.3\times\%Mo+16\times\%N-1.6\times\%Mn-122\times\%S$$

greater than 39.1.

JP05-132741 proposes a super duplex stainless steel which has a PREW defined by $$PREW=\%Cr+3.3\times(\%Mo+0.5\times\%w)+16\times\%N$$

of at least 40.

In addition, the present inventors have proposed in JP04-293844 a super duplex stainless steel showing high corrosion resistance of weld zones which have a PREW of at least 43, a machinability index of up to 65, a difference in pitting resistance of the ferritic phase and that of the austenitic phase of −3.0 to 3.0, a composition less susceptible to formation of σ, χ, and other intermetallic phases than conventional super duplex stainless steels.

The composition of conventional super duplex stainless steels based on 25% Cr steel, comprising larger amounts of Mo and N, enhances greatly the precipitation of σ, χ, and other intermetallic phases during the steelmaking process or in the welding of such steels. The precipitation around weld zones decreases the corrosion resistance considerably, presenting a serious problem in practical applications.

The inner pressure of oil well pipes has been increased in recent years to lower operation costs by increasing the flow rate of the working fluid, hence requirements for duplex stainless steel for well pipes of high resistance to stress corrosion cracking, specifically critical stress for cracking $\sigma_{th}$ of at least 45.5 kgf/mm$^2$ (65 ksi) in a pressurized corrosion environment, and of sufficient toughness of weld joints, specifically Charpy impact value of at least 200 J/cm$^2$ at −30° C.

PREN and PREW described above, determined uniquely by the initial composition of the alloy, have been used as indices of pitting resistance, and regarded as good representations of corrosion rate or pitting resistance of pressurized corrosion environments containing a chloride ion. Super duplex stainless steel has been defined as an alloy with PREN or PREW greater than 40, and is regarded as the most corrosion-resistant alloy in the present state of art.

PREN and PREW are useful, however, only when the steel has an austenite-ferrite duplex structure as a result of appropriate solid solution treatment after hot working. The resistance to stress corrosion cracking of the solidification structure of weld zones or heat affected zones (HAZs hereinafter) that have experienced a thermal history different from that of the homogenized structure in a pressurized corrosion environment, particularly in the presence of hydrogen sulfide, does not correspond to what is inferred from PREN or PREW values obtained from the average composition of the alloy.

The super duplex stainless steels disclosed in JP62-56556 and JP05-132741 mentioned above are not carefully designed as to weldability, nor as to the resistance to stress corrosion cracking and toughness of weld zones.

Another duplex stainless steel disclosed in JP04-293844 by the present inventors is characterized by limited pitting resistance indices for the ferritic and austenitic phases as a principal means of improving the pitting resistance of HAZs, and no attention was paid to weldability and prevention of the stress corrosion cracking of weld zones in a pressurized corrosion environment.

Duplex stainless steel, widely used for oil well pipes, power plants and chemical plants, is required to present high corrosion resistance (resistance to pitting and stress corrosion cracking) as well as ease of welding without weld cracks and other defects. It is therefore desirable to develop a super duplex stainless steel which has excellent mechanical properties and corrosion resistance as well as good weldability. Further it is desirable to develop a super duplex stainless steel which has, in addition to the characteristics mentioned above, a high toughness and resistance to stress corrosion cracking even in the welded zones.

SUMMARY OF THE INVENTION

The inventors found the following facts by studying the sensitivity of a super duplex stainless steel to weld cracks in relation to its chemical composition:

1. A great difference between the liquidus (the temperature at which the solid phase (δ) begins to crystallize from the liquid phase (L) of an alloy of given composition) and solidus (the temperature at which L+δ is completely converted to δ) in the area around the welding head, where liquid and solid phases coexist, tends to result in solidification cracks.

2. Although prevention of solidification cracks requires certain welding conditions, solidification cracks can be controlled by selecting appropriate alloy compositions.

The inventors considered the pitting resistance index PREW as defined in JP05-132741 mentioned above, which is uniquely determined by the initial alloy composition as described above, as a measure of pitting resistance, a fundamental characteristic of duplex stainless steel, and concluded as follows as a result of an attempt to find an alloy composition that would result in an improved resistance to stress corrosion cracking of the weld zones, allowing higher pressures of the working fluid in oil well pipes.

3. The stress corrosion cracking at the weld zone is roughly classified into cracking in the weld bond and that in HAZs. The origin of the crack is related to formation of intermetallic phases such as the σ phase ($Fe_{55}Cr_{31}(Mo+W)_{10}Ni_4$) and χ phase.

A detailed study on effects of alloy components on formation of the σ and χ phases revealed a previously unknown precipitation mechanism of these phases described below which is not deduced from the usual phase diagram of the alloy.

4. In the weld bond, the alloy components are redistributed between the ferritic phase and austenitic phase, concomitant with mixing of the weld metal and the matrix, dilution of alloying elements and solidification, while Cr, Mo and W that promote σ phase formation are concentrated in the ferrite because of the limited solubilities of these elements in austenite. In conventional super duplex stainless steels, the amount of the ferrite decreases quickly during cooling and solidification, which causes Cr, Mo and W to be released from the ferrite and to concentrate on the boundaries of ferrite and austenite.

Further decrease in temperature causes a nonuniform precipitation of the σ phase on the boundaries of ferrite and austenite, which act as starting points of stress corrosion cracking.

These facts suggest that (a) the formation of the σ phase at the weld bond can be controlled by limiting the extent of decrease of the ferrite, and, (b) similarly in HAZs, the σ phase formation will not be too sensitive to the thermal effects of welding if the decrease of the ferrite is suppressed during homogenization and solid solution treatment after hot working.

According to this theory, the inventors sought an alloy composition that presents a small change in the proportion of ferrite and austenite on cooling from around the solidification point, and found that the proportion can be controlled by choosing an appropriate balance between Cr, Mo and W on the one hand and Ni on the other.

The present invention is based on the understanding described above and substantially comprises duplex phase stainless steels (1) and (2) indicated below: (1) A duplex stainless steel containing, by weight, Si: 2.0% or less, Mn: 2.0% or less, Cr: 22.0–24.0%, Ni: 4.5–6.5%, Mo: 4.0–4.8%, Al: 0.001–0.15%,

N: 0.25–0.35% N, the remainder of Fe and inevitable impurities including 0.03% or less C, 0.05% or less P and 0.005% or less S, which has an RVS value defined by equation ① below, 7 or less, and a PREW value defined by equation ② below, greater than 40:

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②$$

and (2) A duplex stainless steel containing, in addition to the alloying elements listed in (1) above, at least one element selected from at least one of group 1, group 2, and group 3 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:

Group 1 elements

Cu: 0.01–2.0%

W: 0.01–1.5%

Group 2 elements

V: 0.01–0.50%

Ti: 0.01–0.50%

Nb: 0.01–0.50%

Group 3 elements

Ca: 0.0005–0.010%

Mg: 0.0005–0.010%

B: 0.0005–0.010%

Zr: 0.01–0.50%

Y: 0.001–0.20%

Rare earth elements: 0.0005–0.010%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times W\%)+16\times\%N \quad ②.$$

The duplex stainless steels as described in (1) and (2) above should preferably have an RSCC value of 13 to 18 defined by equation ③ below:

$$RSCC=[3\times(\%Cr/52.0)+(\%Mo/95.94)+(\%W/183.85)]/(\%Ni/58.71) \quad ③.$$

The W content in the equations ① to ③ above should naturally be regarded as zero for such duplex stainless steels according to the invention as not to contain W substantially.

BRIEF DESCRIPTION OF DRAWINGS

FIGS. 1 and 2 show the chemical compositions of the steels described in Example 1 below designed to give values of the pitting resistance index PREW FIGS. 3(*a*), 3(*b*) and 3(*c*) illustrates the varestraint test for evaluation of susceptibility to weld cracks.

FIGS. 4 and 5 represent the test results on the steels prepared in Example 1 along with the PREWs and RVSs, as well as RSCCs for information.

FIGS. 7, 8 and 9 show the chemical compositions of the steel described in Example 2 for which the corrosion resistance and other characteristics of the weld zones were evaluated.

FIGS. 12(*a*) through 12(*c*) show the sampling position for the Charpy impact test, along with the geometry of the test piece.

FIGS. 13, 14 and 15 show the test results on the steels prepared in Example 2 along with the ferrite fractions (α), PREWs, RVSs, RSCCs and ferrite increments (changes in α).

FIGS. 16, 17 and 18 summarize the results of the tensile tests, Charpy impact tests and stress corrosion cracking tests on the steels in Example 2.

DETAILED DESCRIPTION OF THE INVENTION

I. Alloying elements and impurities

Figure 3A:
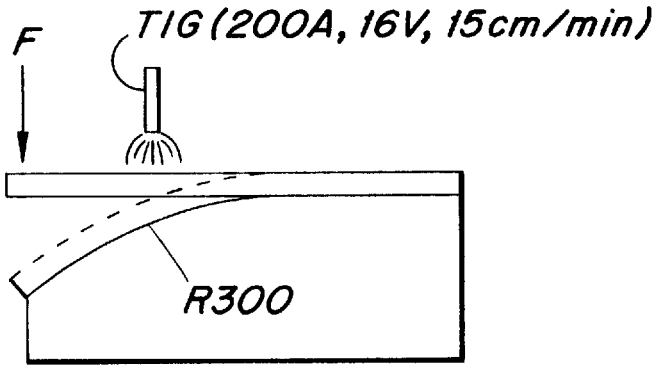

The reason for which the amounts of the alloying elements were chosen as described above is explained below. All the percentage values for the composition mean weight percent.

Si: Si is indispensable for enhancing the corrosion resistance of steel by deoxidation. The lower limit is substantially zero or a trace amount because Si need not remain in the steel; the upper limit is 2.00% above which Si embrittles the steel.

Mn: Mn is added for deoxidation and desulfurization. A concentration higher than 2.0%, the upper limit, will decrease the corrosion resistance. The lower limit is substantially zero or a trace amount for the same reason as for Si.

Cr: Being an essential component of duplex stainless steel, Cr is important to control the corrosion resistance along with Mo. A Cr concentration of at least 22.0% is needed for a high resistance to a pressurized corrosion environment. In a steel according to the invention, a Cr concentration higher than 24% promotes the precipitation of intermetallic phases such as the $\sigma$ or $\chi$ phase due to a Mo level higher than in conventional steels (4–4.8%). Thus, the Cr concentration range has been set from 22.0% to 24.0%.

Ni: Having conventionally been added to form a duplex structure in an amount determined in relation to those of Cr, Mo, W and N, Ni is one of the most important element in the present invention which controls the toughness and resistance to stress corrosion cracking of weld bonds and HAZs. A concentration of 4.5% or higher is needed for the desired corrosion resistance, while a level higher than 6.5% promotes the precipitation of the $\sigma$ phase greatly. Thus, the Ni concentration range has been set from 4.5% to 6.5%.

Mo: Another element that enhances corrosion resistance, Mo is needed at a concentration of 4.0% or higher to obtain the desired resistance in a pressurized corrosion environment. The upper limit of Mo concentration has been set at 4.8% above which the $\sigma$ phase coagulates rapidly.

Al: An important deoxidation agent, Al is used to enhance the corrosion resistance of steel by reducing the oxygen content. Al concentration depends on Si and Mu concentrations, and limited between 0.001%, below which the effect is insignificant, and 0.15% above which AlN tends to precipitate to deteriorate the toughness and corrosion resistance of the alloy.

N: In super duplex stainless steel containing a high concentration of the ferrite-forming Cr and Mo, N is important to stabilize the austenitic phase to form the duplex structure, and is also most effective in pitting resistance enhancement. It is not enough to obtain these effects at a N concentration less than 0.25%. However, a concentration higher than 0.35% gives rise to many defects such as blow holes in a large ingot, rendering the hot working very difficult. Thus the N concentration limits have been set from 0.25% to 0.35%.

One form of the duplex stainless steels according to the invention consists of the alloying elements described above, the balance being Fe and inevitable impurities. The upper limits of typical impurities are given later.

Another form of the steels according to the invention contains, in addition to the alloying elements described above, at least one element selected from the group 1, group 2, and group 3 elements listed earlier. These elements are described in the following.

Group 1 elements (Cu and W):

These elements improve the corrosion resistance of steel. One or two of the elements are added when necessary. W acts as a complement to Mo, and can be present at a concentration of 0.01% or higher, but addition of more than 1.5% will result in too high production costs.

Cu is effective in improving the acid resistance of steel and used when necessary at a level higher than 0.01%. A concentration higher than 2.0% will render the hot working difficult.

Group 2 elements (V, Ti and Nb):

One or more of these elements are added when necessary to stabilize the carbides and to enhance corrosion resistance. These effects appear at a concentration of 0.01% or higher and saturates above 0.50%.

Group 3 elements (Ca, Mg, B. Zr, Y and rare earth elements):

Ca, Mg, Y and rare earth elements form sulfide oxide compounds to facilitate the hot working of steel. These effects appear at a concentration of 0.0005% (0.001% for Y) or higher and saturates above 0.010% (0.20% for Y).

B and Zr segregate at grain boundaries to lower the grain boundary energy and help facetting of the grain boundaries. This increases grain boundary strength, resulting in improved hot working behavior of the steel. Such an effect appears at a B concentration of 0.0005% or higher, and a Zr concentration of 0.01% or higher, and saturates above 0.010% B or 0.50% Zr. Therefore, the concentration limits have been set to 0.0005–0.010% for B and 0.01–0.50% for Zr.

Addition of two or more of these elements is known to have synergistic effects. Rare earth elements can be added either as single elements such as La or Ce, or as a mixture such as misch metal.

The concentration limits of impurities are explained below. Principal impurities include C, P and S.

C: Steel contains carbon, but the concentration should be as low as possible because precipitation of carbides in HAZs deteriorates the corrosion resistance greatly. The upper limit of tolerance is 0.03%.

P: Another inevitable impurity in steel, P renders hot working difficult and deteriorates the corrosion resistance, and, therefore, should be kept at as low a level as possible. The upper limit has been set to 0.05% in view of dephosphorizing costs.

S: S is also an inevitable impurity, which impairs hot working performance of duplex stainless steel, and should therefore be kept at as low a level as possible. The upper limit of tolerance is 0.005%.

II. PREW, RVS and RSCC

The present specification uses PREW as defined by equation ② above, taken from JP05-132741, as a measure of pitting resistance. The lower limit of PREW was set at 40 to assure a high pitting resistance, an essential characteristic of duplex stainless steel.

In addition to PREW, the present specification introduces RVS as an index of crack susceptibility on welding, and RSCC as an index of the resistance to stress corrosion cracking of welds and the toughness of HAZs used as necessary.

RVS defined by equation ① above indicates the temperature difference between the liquidus and solidus in the welding head where liquid and solid phases coexist. The RVS value shows a definite correlation with the susceptibility of the weld to cracking.

Figure 6:
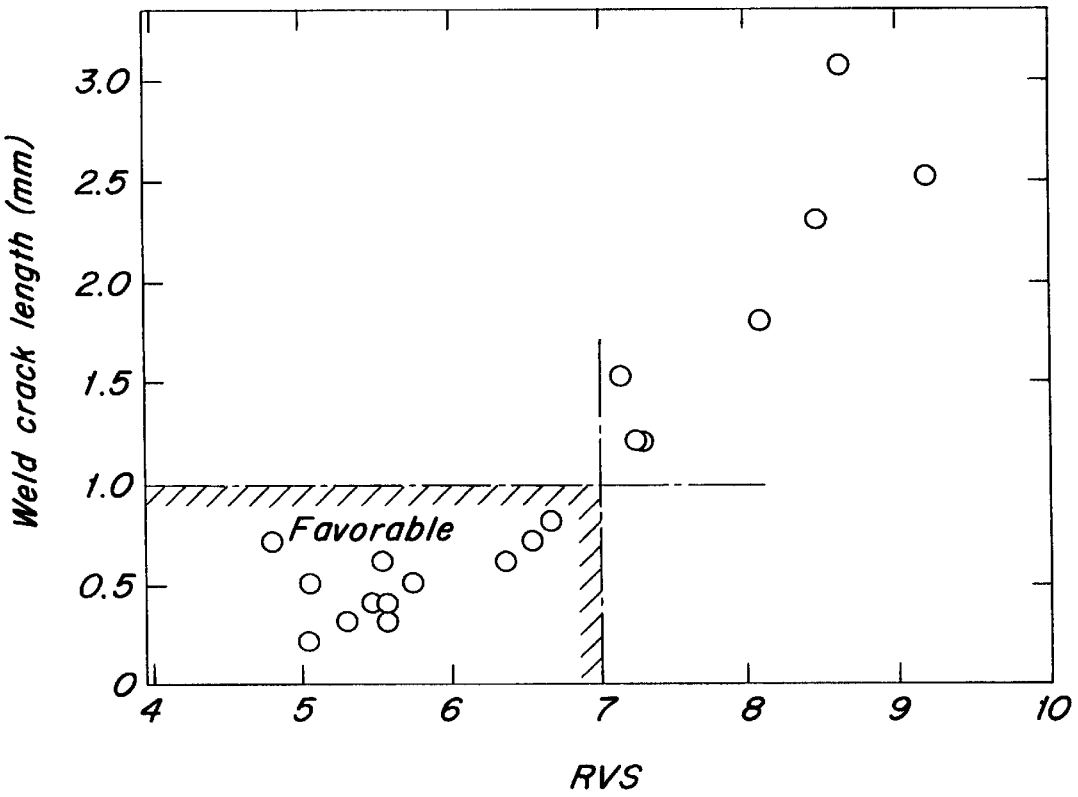
FIG. 6 shows the relationship of the crack length observed in varestrait test and RVS.

FIG. 6 shows the correlation of the crack lengths observed in varestraint tests to the RVS values for TIG-welded duplex stainless steel described in Example 1 below. The susceptibility of the steel to weld crack is low at a RVS up to 7, and crack length remains less than 1 mm, while the susceptibility is high enough at a RVS higher than 7, where cracks longer than 1 mm develop. The present invention, therefore, specifies an upper limit of 7 for RVS.

RSCC defined by equation ③ above indicates the tendency for intermetallic phases such as the σ and χ phases to precipitate nonuniformly at the boundaries of ferrite and austenite due to rapid decrease in ferrite fraction in weld bonds and HAZs during cooling. Therefore, RSCC correlates well with the resistance to stress corrosion cracking and the toughness of the weld zones.

The "ferrite fraction" mentioned above is calculated by equation ④ below (as volume %) from the amount of ferrite and austenite in a test piece of duplex stainless steel which has been held at 1100° C. for 1 hr and water-cooled, measured e.g. by x-ray diffraction.

$$\text{Ferrite fraction}=\{\text{amount of ferrite/amount of (ferrite+austenite)}\}\times 100 \quad ④$$

The "ferrite increment" mentioned below is defined as the difference in the ferrite fraction determined for a test piece of duplex stainless steel held at 1300° C. for 1 hr and water-cooled, and that for a test piece held at 1100° C. for 1 hr and water-cooled.

Figure 19A:
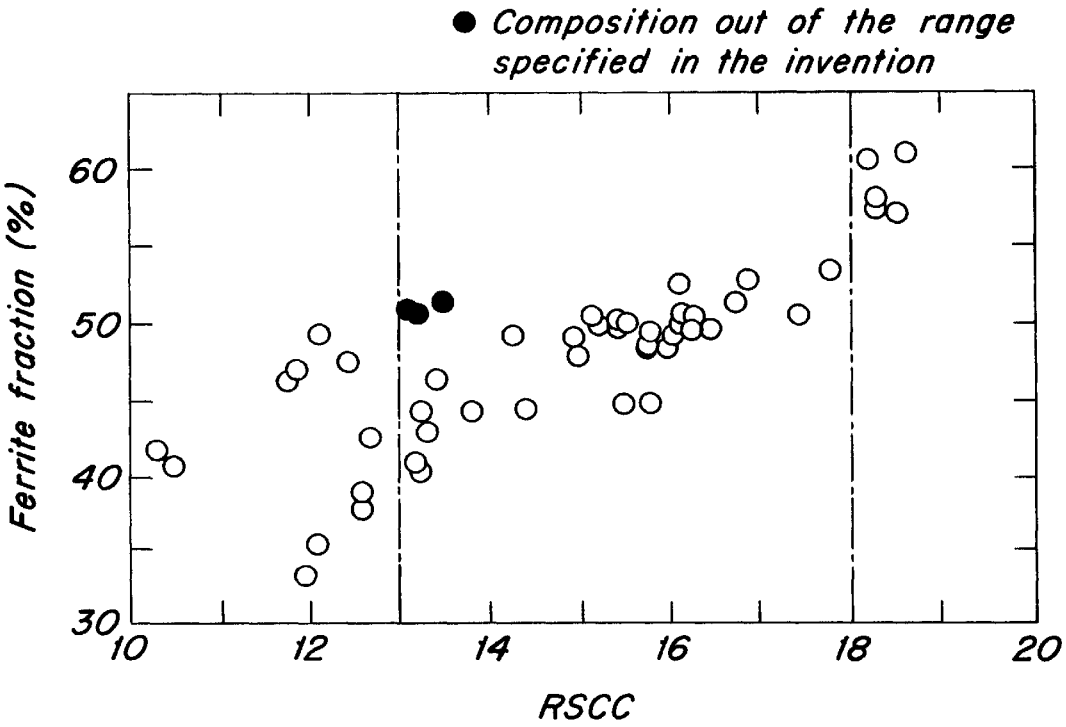
FIGS. 19(*a*) and 19(*b*) represent the relationship of the ferrite fraction and ferrite increment to RSCC of duplex stainless steels of Example 2.
Figure 19B:
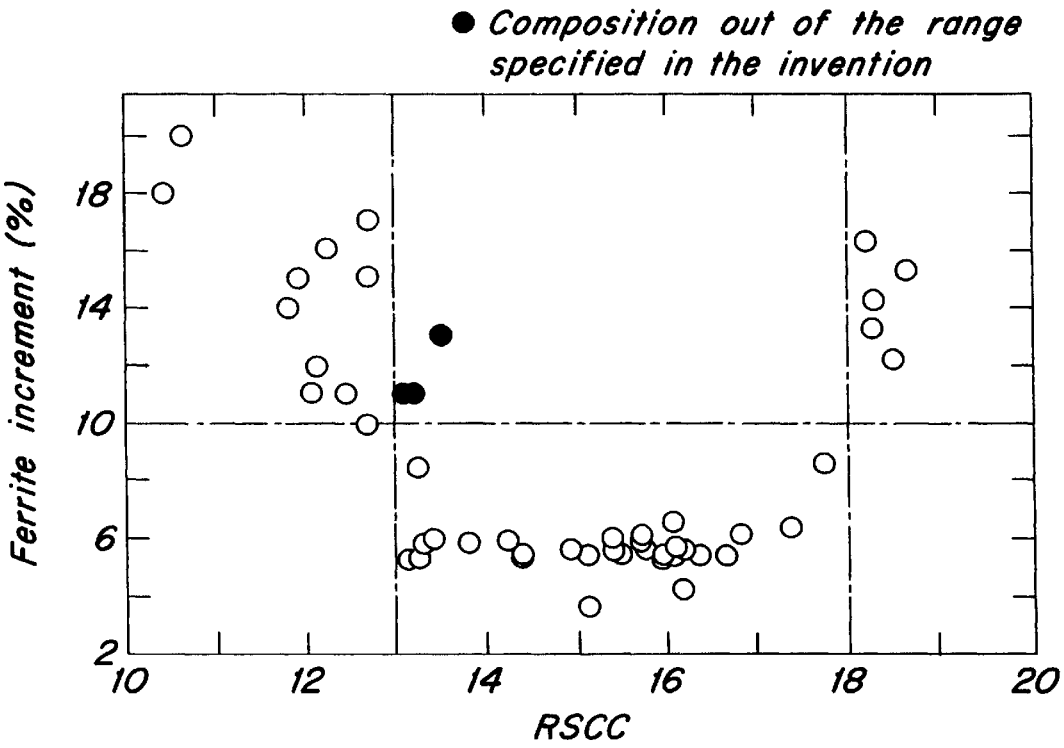
Figure 20:
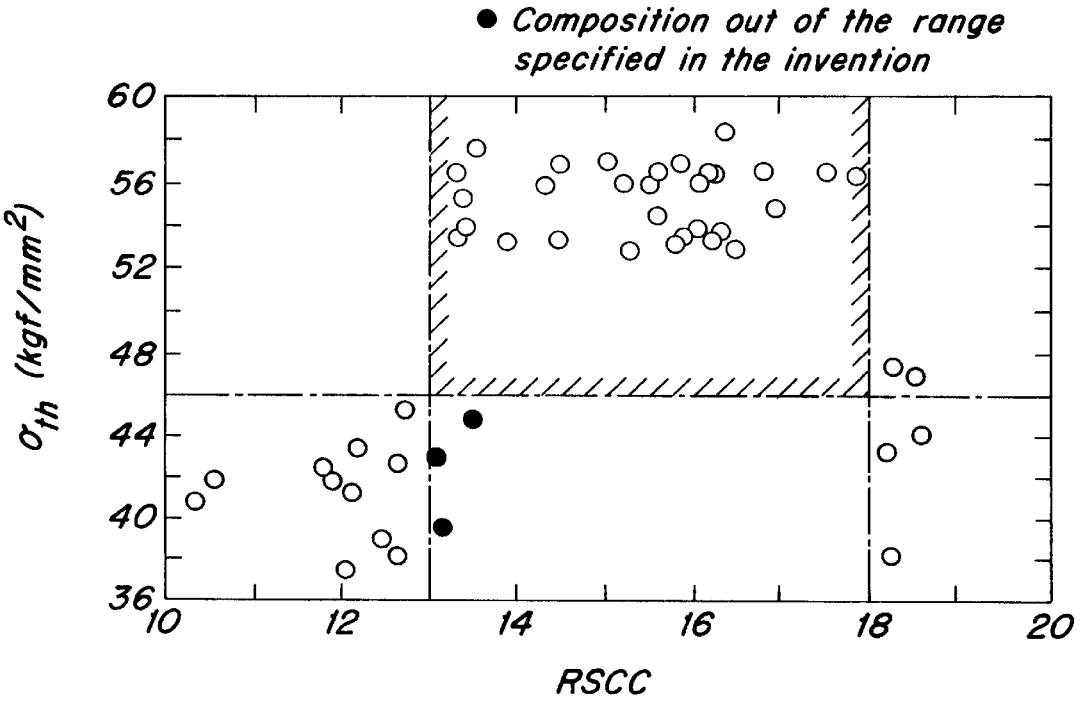
FIG. 20 represents the relationship of critical stress for cracking ($\sigma_{th}$) observed in stress corrosion cracking test, to RSCC of the steels of Example 2.
Figure 21:
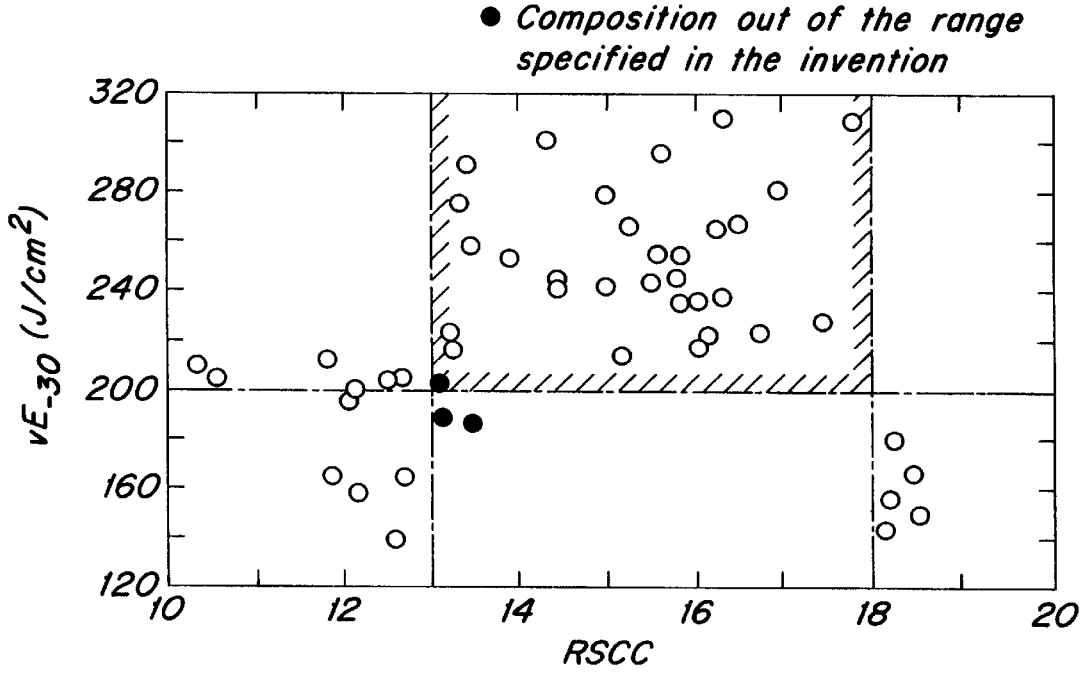
FIG. 21 represents the relationship of the impact value ($vE_{-30}$, observed in Charpy impact test, to RSCC of duplex stainless steels of Example 2.

FIGS. 19–21 show the ferrite fraction, ferrite increment, critical stress for stress corrosion cracking, and impact resistance of the duplex stainless steels described in Example 2 below as related to RSCC. FIG. 19(*b*) shows that an RSCC lower than 13 results in a high ferrite increment, and FIG. 19(*a*) that an RSCC higher than 18 lead to a very high ferrite fraction. The toughness is low in either case so that the impact resistance $vE_{-30}$ is lower than 200 J/cm$^2$, as shown by FIG. 21. The resistance to stress corrosion cracking also decreases in such cases, as shown by FIG. 20, so that the critical stress for cracking is lower than 45.5 kgf/mm$^2$. These results show that a RSCC between 13 and 18 is desirable.

Advantages of the duplex stainless steels according to the invention is further illustrated by Examples 1 and 2 that follow.

EXAMPLE 1

Steels with the chemical compositions shown in FIGS. 1 and 2, which assure values over 40 of the pitting resistance index PREW, were prepared in a 150 kg vacuum induction furnace and cast into ingots 150 mmϕ in diameter, which were subsequently worked into 20 mm thick slabs by hot forging and hot rolling. The slabs then underwent a solid solution treatment consisting of heating to 1100° C. for one hour and water cooling. Welding test pieces were prepared from the slabs. "Invention" in the figures means duplex stainless steels according to the invention, "reference" steels for comparison of characteristics, and "conventional" steels corresponding to existing duplex stainless steels.

Figure 3B:
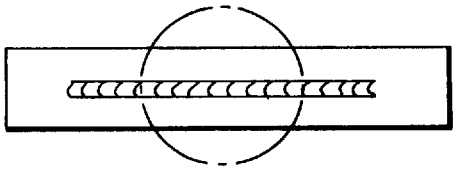
Figure 3C:
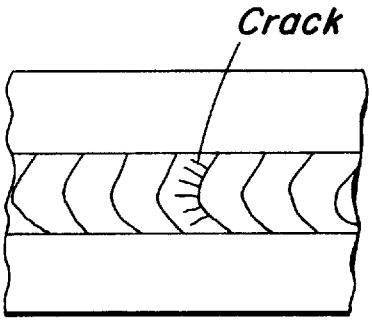

FIG. 3 illustrates the varestraint test to evaluate the susceptibility of steels to welding crack. Test pieces each 12 mm thick, 50 mm wide, and 300 mm long undergo TIG welding under a bending stress to generate cracks in the weld zone. The crack length is measured under microscope (×100). The sum of the observed lengths are used as an index of the susceptibility to weld crack. Steels for which the total crack length is 1 mm or less were considered as satisfactory for the purpose of the invention.

The test results along with PREW and RVS are shown in FIGS. 4 and 5, as well as RSCC for information. The relationship of the weld crack length to RVS is shown in FIG. 6.

Steels Nos. 1–12 in FIG. 4 according to the invention have low susceptibility to weld cracks, as indicated by the crack lengths of 0.2–0.8 mm, corresponding to PREWs of 42.6 or higher and RVSs between 4.78 and 6.68.

Steels Nos. 13, 18 and 19 shown in FIG. 5 as references, with RVSs over 7, show high susceptibility to weld cracks as indicated by the total crack lengths of 1.2, 1.2 and 1.5 mm. Steels Nos. 14, 15, 16 and 17 also have RVSs over 7 due to either Cr, Ni or Mo out of the composition range specified earlier, and correspondingly high susceptibility to weld cracks, the total lengths of actual cracks being 3.1, 2.3, 2.5 and 1.8 mm FIGS. 4, 5, and 6 demonstrate that a duplex stainless steel with a composition designed to give an RVS of 7 or less, by limiting the concentration ranges of Cr, Ni and Mo, shows reduced weld crack development that facilitate welding.

EXAMPLE 2

Test pieces of the steels with the chemical compositions shown in FIGS. 7, 8 and 9 were prepared as in Example 1 above for evaluation of the corrosion resistance and other characteristics of the weld zones. These compositions were designed to present PREWs higher than 40 and, except for some comparisons, present RVSs up to 7.

Figure 10:
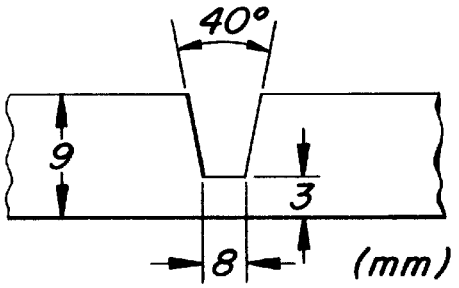
FIG. 10 illustrates the geometry of a bevel for the welding test.
Figure 11A:
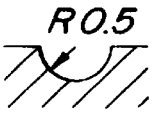
FIGS. 11(*a*) and 11(*e*) show the sampling position for the stress corrosion cracking test, along with the geometry of the test piece.
Figure 11B:
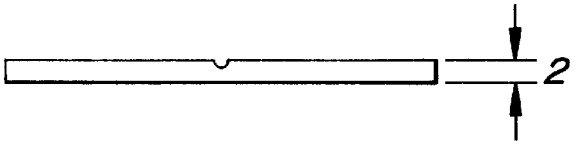
Figure 11C:
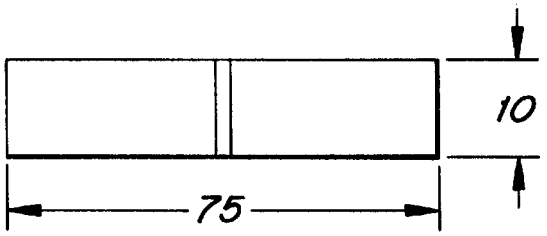
Figure 11D:
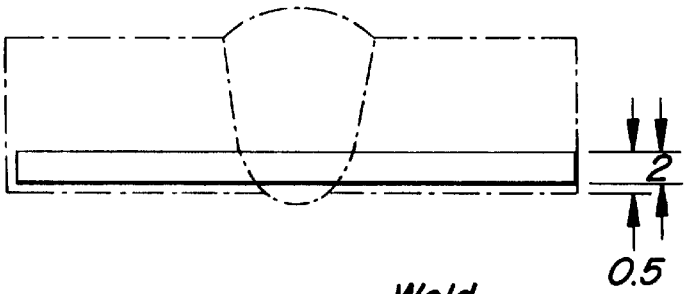
Figure 11E:
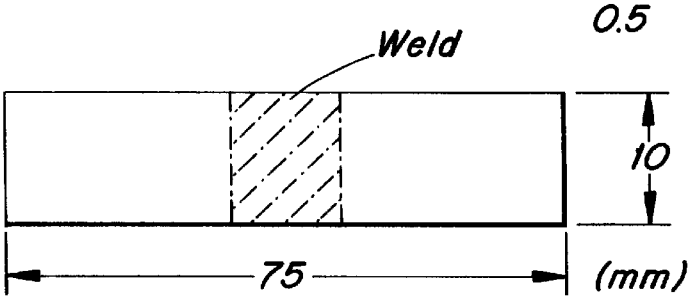

FIG. 10 shows a bevel for preparation of a test weld joint. A 9 mm thick plate was cut from a 20 mm thick slab prepared as in Example 1, on which a bevel of the illustrated dimension was formed. Automatic TIG welding was performed at a velocity of 10 cm/min with a heat input of 15 kJ/cm. The first layer was deposited without a filler metal, while a filler metal 25% Cr-7% Ni-3% Mo-2% W-0.3% N was used to form the second to the thirteenth layer.

FIGS. 11 and 12 illustrate the sampling positions on the weld joint. A test piece for stress corrosion cracking 2 mm thick, 10 mm wide and 75 mm long was taken from the position shown in FIG. 11(*b*). As an impact strength test piece, a half-size Charpy test piece illustrated in FIG. 12(*b*) was taken from the position shown in FIG. 12(*a*). The test conditions were as follows:

1. Tensile test
   - Temperature: Room temperature
   - Test piece: 6.0 mm in diameter, 30 mm in test length (GL)
   - Strain rate: $1.0\times10^{-3}$ s$^{-1}$
   - Obtained data: 0.2% Proof stress, elongation, constriction
2. Stress corrosion cracking
   - Solution: 5% NaCl, 0.1 atm $H_2$–30 atm $CO_2$
   - Temperature: 80° C.
   - Loading: Four-point bending
   - Stress applied: 0.8, 0.85, 0.9, 0.95 and 1.0 times 0.2% proof strength of the bulk material
   - Soaking time: 720 hr 3. HAZ toughness (Charpy test)

Temperature: −30° C.

Test piece: Half size (geometry shown in FIG. 12)

Test results are summarized in FIGS. 13 to 18. The ferrite fraction is designated as α and the ferrite increment as change in α in FIGS. 13 to 15.

Steels Nos. 1–33 according to the invention have compositions, PREWs, RVSs and RSCCs within the ranges specified earlier in this specification, and therefore, have low weld crack susceptibility as explained in relation to Example 1 above. Weld joints of these steels have high toughness and stress corrosion cracking resistance, as indicated by impact values of 212 J/cm$^2$ or higher at −30° C. and critical stress for stress corrosion cracking of 52.6 kgf/mm$^2$ or higher shown in FIGS. 16 and 17.

In contrast, conventional duplex stainless steels Nos. 34–42 have Cr, Ni, Mo or N concentrations out of the range specified in this invention, and show RSCCs less than 13 except for Nos. 39, 40 and 42. Correspondingly, stress corrosion cracking resistance of weld joints of these steels are low, as illustrated by FIG. 18 with critical stresses for cracking of 44.6 kgf/m$^2$ or lower, as well as low impact values for some of the specimens.

Reference steels Nos. 43–52 have compositions within the ranges specified in the present invention, but RSCCs lower than 13 or higher than 18. Either the impact values or the critical stress for stress corrosion cracking is too low for these steels so that an impact value of 200 J/cm$^2$ or higher and a critical stress for cracking of 45.5 kgf/mm$^2$ or higher are not simultaneously achieved. Among these steels with RSCCs less than 13 or more than 18, those with PREWs and RVSs within the ranges specified in this invention can be regarded as steels according to the invention in a wider sense.

FIG. 19 shows the relationship of the ferrite fractions and ferrite increments with RSCCs for the duplex stainless steels described in Example 2 above. The ferrite fraction increases fairly insignificantly with increasing RSCC, as shown in (a), while the ferrite increment is low and stable for RSCCs between 13 and 18 as shown in (b).

FIGS. 20 and 21 show the relationship of the critical stress for cracking ($\sigma_{th}$) obtained in the stress corrosion cracking test and the HAZ toughness ($vE_{-30}$) obtained in the welding test with RSCC for the weld zones of the duplex stainless steels described in Example 2 above. Both parameters show favorable values for RSCCs between 13 and 18, clearly corresponding to FIG. 19.

POSSIBLE INDUSTRIAL APPLICATIONS

Duplex stainless steels according to the invention represents super duplex stainless steels that have excellent weldability with low susceptibility to weld cracks. In addition, those with RSCC values, an index representing the resistance to stress corrosion cracking of the weld zones and the toughness of HAZs, between 13 and 18 have high resistance to stress corrosion cracking and toughness of the weld zone. Therefore, such steels are suitable for heat exchangers exposed to sea water, brine-resistant equipment and structures, pipings in chemical plants, line pipes, and oil well pipes, and presents possibility of applications in a variety of fields including chemical industry and marine development.

We claim:

1. A duplex stainless steel containing, by weight,

Si: 2.0% or less, Mn:2.0% or less,

Cr: 22.0–24.0%, Ni: 4.5–6.5%,

Mo: 4.0–4.8%, Al: 0.001–0.15%,

N: 0.25–0.35%, the remainder of Fe and inevitable impurities including 0.03% or less C, 0.05% or less P and 0.005% or less S, which has an RVS value defined by equation ① below, 7 or less, and a PREW value defined by equation ② below, greater than 40:

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

2. A duplex stainless steel containing, by weight,

Si: 2.0% or less, Mn:2.0% or less,

Cr: 22.0–24.0%, Ni: 4.5–6.5%,

Mo: 4.0–4.8%, Al: 0.001–0.15%,

N: 0.25–0.35%, and one or two elements selected from group 1 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:

Group 1 elements

Cu: 0.01–2.0%

W: 0.01–1.5%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

3. A duplex stainless steel containing, by weight,

Si: 2.0% or less, Mn:2.0% or less,

Cr: 22.0–24.0%, Ni: 4.5–6.5%,

Mo: 4.0–4.8%, Al: 0.001–0.15%,

N: 0.25–0.35%, and at least one element selected from group 2 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:

Group 2 elements

V: 0.01–0.50%

Ti: 0.01–0.50%

Nb: 0.01–0.50%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

4. A duplex stainless steel containing, by weight,

Si: 2.0% or less, Mn:2.0% or less,

Cr: 22.0–24.0%, Ni: 4.5–6.5%,

Mo: 4.0–4.8%, Al: 0.001–0.15%,

N: 0.25–0.35%, and at least one element selected from group 3 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:

Group 3 elements
Ca: 0.0005–0.010%
Mg: 0.0005–0.010%
B: 0.0005–0.010%
Zr: 0.01–0.50%
Y: 0.001–0.20%
Rare earth elements: 0.0005–0.010%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

5. A duplex stainless steel containing, by weight,
Si: 2.0% or less, Mn:2.0% or less,
Cr: 22.0–24.0%, Ni: 4.5–6.5%,
Mo: 4.0–4.8%. Al: 0.001–0.15%,
N: 0.25–0.35%,
and at least one element each selected from group 1 and 2 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:
Group 1 elements
Cu: 0.01–2.0%
W: 0.01–1.5%
Group 2 elements
V: 0.01–0.50%
Ti: 0.01–0.50%
Nb: 0.01–0.50%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

6. A duplex stainless steel containing, by weight,
Si: 2.0% or less, Mn:2.0% or less,
Cr: 22.0–24.0%, Ni: 4.5–6.5%,
Mo: 4.0–4.8%, Al: 0.001–0.15%,
N: 0.25–0.35%,
and at least one element each selected from group 1 and 3 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:
Group 1 elements
Cu: 0.01–2.0%
W: 0.01–1.5%
Group 3 elements
Ca: 0.0005–0.010%
Mg: 0.0005–0.010%
B: 0.0005–0.010%
Zr: 0.01–0.50%
Y: 0.001–0.20%
Rare earth elements: 0.0005–0.010%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

7. A duplex stainless steel containing, by weight,
Si: 2.0% or less, Mn:2.0% or less,
Cr: 22.0–24.0%, Ni: 4.5–6.5%,
Mo: 4.0–4.8%, Al: 0.001–0.15%,
N: 0.25–0.35%,
and at least one element each selected from group 2 and 3 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:
Group 2 elements
V: 0.01–0.50%
Ti: 0.01–0.50%
Nb: 0.01–0.50%
Group 3 elements
Ca: 0.0005–0.010%
Mg: 0.0005–0.010%
B: 0.0005–0.010%
Zr: 0.01–0.50%
Y: 0.001–0.20%
Rare earth elements: 0.0005–0.010%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

8. A duplex stainless steel containing, by weight,
Si: 2.0% or less, Mn:2.0% or less,
Cr: 22.0–24.0%, Ni: 4.5–6.5%,
Mo: 4.0–4.8%, Al: 0.001–0.15%,
N: 0.25–0.35%,
and at least one element each selected from group 1, 2 and 3 elements listed below, the remainder of Fe and inevitable impurities including 0.03% or less C, 0.05% or less P and 0.005% or less S, which has an RVS value defined by equation ① below, 7 or less, and a PREW value defined by equation ② below, greater than 40:
Group 1 elements
Cu: 0.01–2.0% Cu
W: 0.01–1.5% W
Group 2 elements
V: 0.01–0.50%
Ti: 0.01–0.50%
Nb: 0.01–0.50%
Group 3 elements
Ca: 0.0005–0.010%
Mg: 0.0005–0.010%
B: 0.0005–0.010%
Zr: 0.01–0.50%
Y: 0.001–0.20%
Rare earth elements: 0.0005–0.010%

$$RVS=[1.100\times(\%Cr/52.0)+9.888\times(\%Mo/95.94)+2.045\times(\%W/183.85)]/1.738\times(\%Ni/58.71) \quad ①$$

$$PREW=\%Cr+3.3\times(\%Mo+0.5\times\%W)+16\times\%N \quad ②.$$

9. A duplex stainless steel as claimed in claim 1 above which has a RSCC value of 13 to 18 defined by equation ③ below:

$$RSCC=[3\times(\%Cr/52.0)+(\%Mo/95.94)+(\%W/183.85)]/(\%Ni/58.71) \quad ③.$$

10. A duplex stainless steel as claimed in claim 2 which has a RSCC value of 13 to 18 defined by equation ③ below:

$$RSCC=[3\times(\%Cr/52.0)+(\%Mo/95.94)+(\%W/183.85)]/(\%Ni/58.71) \quad ③.$$

11. A duplex stainless steel as claimed in claim 3 which has a RSCC value of 13 to 18 defined by equation ③ below:

$$RSCC=[3\times(\%Cr/52.0)+(\%Mo/95.94)+(\%W/183.85)]/(\%Ni/58.71) \quad (3).$$

12. A duplex stainless steel as claimed in claim 4 which has a RSCC value of 13 to 18 defined by equation (3) below:

$$RSCC=[3\times(\%Cr/52.0)+(\%Mo/95.94)+(\%W/183.85)]/(\%Ni/58.71) \quad (3).$$

13. A duplex stainless steel as claimed in claim 5 which has a RSCC value of 13 to 18 defined by equation (3) below:

$$RSCC=[3\times(\%Cr/52.0)+(\%Mo/95.94)+(\%W/183.85)]/(\%Ni/58.71) \quad (3).$$

14. A duplex stainless steel as claimed in claim 6 which has a RSCC value of 13 to 18 defined by equation (3) below:

$$RSCC=[3\times(\%Cr/52.0)+(\%Mo/95.94)+(\%W/183.85)]/(\%Ni/58.71) \quad (3).$$

15. A duplex stainless steel as claimed in claim 7 which has a RSCC value of 13 to 18 defined by equation (3) below:

$$RSCC=[3\times(\%Cr/52.0)+(\%Mo/95.94)+(\%W/183.85)]/(\%Ni/58.71) \quad (3).$$

16. A duplex stainless steel as claimed in claim 8 which has a RSCC value of 13 to 18 defined by equation (3) below:

$$RSCC=[3\times(\%Cr/52.0)+(\%Mo/95.94)+(\%W/183.85)]/(\%Ni/58.71) \quad (3).$$

* * * * *